United States Patent [19]

Keyes et al.

[11] Patent Number: 4,459,710

[45] Date of Patent: Jul. 17, 1984

[54] PASSIVE DISPENSER

[75] Inventors: George B. Keyes; Randall G. Richards, both of Cincinnati, Ohio

[73] Assignee: The Drackett Company, Cincinnati, Ohio

[21] Appl. No.: 434,762

[22] Filed: Oct. 18, 1982

[51] Int. Cl.[3] ..... E03D 9/02

[52] U.S. Cl. ..... 4/228

[58] Field of Search ..... 4/227, 228; 422/263, 422/264; 222/424.5

[56] References Cited

U.S. PATENT DOCUMENTS

| | | | |
|---|---|---|---|
| 252,556 | 1/1882 | Warren . | |
| 650,161 | 5/1900 | Williams et al. | 4/228 |
| 730,494 | 6/1903 | Venners | 4/228 |
| 969,729 | 9/1910 | Smith | 4/228 |
| 991,825 | 5/1911 | Bogie | 4/228 |
| 1,144,525 | 6/1915 | Blake | 4/228 |
| 1,175,032 | 3/1916 | Williams | 4/228 |
| 1,213,978 | 1/1917 | Thornton | 4/227 |
| 1,987,689 | 1/1935 | Lewis | 4/227 |
| 2,688,754 | 9/1954 | Willets et al. | 4/228 |
| 2,839,763 | 6/1958 | Newsom | 4/227 |
| 3,121,236 | 2/1964 | Yadro et al. | 4/228 |
| 3,339,801 | 9/1967 | Hronas | 4/228 |
| 3,407,412 | 10/1968 | Spear | 4/228 |
| 3,423,182 | 1/1969 | Klasky | 4/228 |
| 3,444,566 | 5/1969 | Spear | 4/228 |
| 3,504,384 | 4/1970 | Radley et al. | 4/228 |
| 3,521,306 | 7/1970 | Jacobs | 4/228 |
| 3,604,020 | 9/1971 | Moisa | 4/228 |
| 3,618,143 | 11/1971 | Hill | 4/228 |
| 3,715,765 | 2/1973 | Yadro | 4/228 |
| 3,769,640 | 11/1973 | Castronovo | 4/228 |
| 3,772,715 | 11/1973 | Nigro | 4/228 |
| 3,778,849 | 12/1973 | Foley | 4/228 |
| 3,781,926 | 1/1974 | Levey | 4/228 |
| 3,864,763 | 2/1975 | Spransy | 4/228 |
| 3,867,101 | 2/1975 | Herring | 4/228 |
| 3,934,279 | 1/1976 | Mallin | 4/228 |
| 3,943,582 | 3/1976 | Daeninckx et al. | 4/228 |
| 3,952,339 | 4/1976 | Baur et al. | 4/228 |
| 3,965,497 | 6/1976 | Corsette | 4/228 |
| 4,064,572 | 12/1977 | Wicks et al. | 4/228 |
| 4,171,546 | 10/1979 | Dirksing | 4/228 |
| 4,186,856 | 2/1980 | Dirksing | 4/228 |
| 4,208,747 | 6/1980 | Dirksing | 4/228 |
| 4,216,027 | 8/1980 | Wages | 4/228 |
| 4,244,062 | 1/1981 | Corsette | 4/228 |
| 4,251,012 | 2/1981 | Owens et al. | 4/228 |
| 4,281,421 | 8/1981 | Nyquist et al. | 4/227 X |
| 4,305,162 | 12/1981 | Cornelisse, Jr. et al. | 4/228 |
| 4,307,474 | 12/1981 | Choy | 4/228 |
| 4,357,718 | 11/1982 | Corsette | 4/228 |

FOREIGN PATENT DOCUMENTS

| | | | |
|---|---|---|---|
| 2916247 | 10/1980 | Fed. Rep. of Germany . | |
| 91804 | 11/1921 | Switzerland . | |
| 28813 | 11/1905 | United Kingdom . | |
| 379553 | 9/1932 | United Kingdom . | |
| 705904 | 3/1954 | United Kingdom . | |
| 916652 | 1/1963 | United Kingdom . | |
| 1081032 | 8/1967 | United Kingdom . | |
| 2090884 | 7/1982 | United Kingdom | 4/227 |

*Primary Examiner*—Charles E. Phillips

*Attorney, Agent, or Firm*—Charles J. Zeller

[57] ABSTRACT

A passive dispenser adapted for placement in a body of liquid for dispensing materials, such as toilet tank additives, e.g., disinfectants, detergents, dyes, fragrances, and the like, in solution form from the dispenser in response to a lowering of the height of the body of liquid from a first elevation to a second elevation, the dispenser comprising two dispensing sections, the first dispensing section comprising a first product chamber containing a water-soluble cake, forming upon dissolution the first solution, and the second dispensing section comprising a second product chamber and a third product chamber, each said chamber containing a water-soluble cake, forming upon dissolution the second solution, the third chamber being disposed at least partially above the second chamber, there being fluid communication means therebetween, said second section being in separate relationship from the first section. When adapted for use as a toilet tank dispenser, the cake contained in the first section is a surfactant cake, containing in addition to one or more surface-active constituents optional ingredients such as dyes and fragrances, while the cakes contained in the second section are disinfectant cakes containing a halogen-releasing agent having a water solubility of less than 5.0 gms./100 gms. water at 77° F.

17 Claims, 7 Drawing Figures

FIG. 6
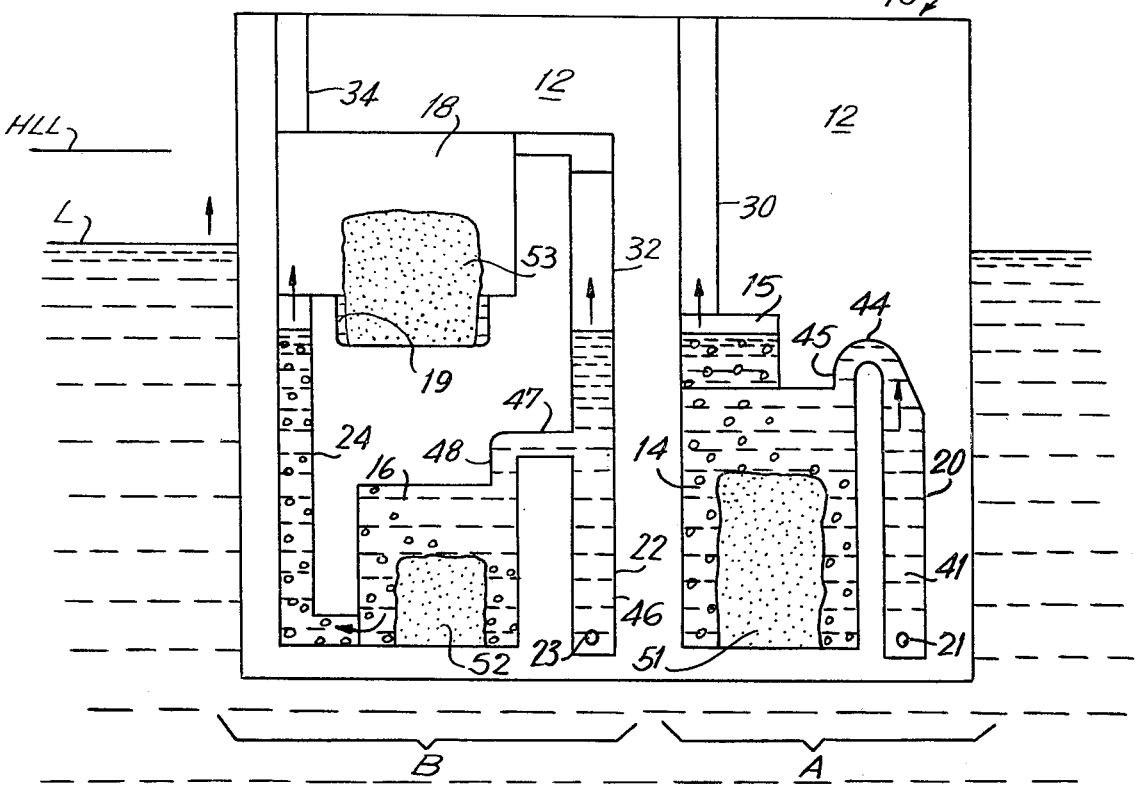
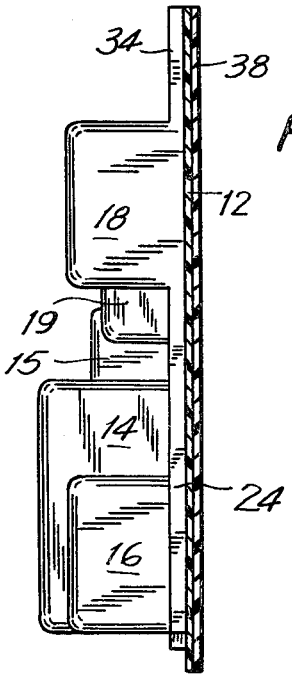
FIG. 7

PASSIVE DISPENSER

FIELD OF INVENTION

The present invention relates to a passive dispenser, adapted for placement in a body of liquid, for dispensing materials, such as toilet tank additives, e.g., disinfectants, detergents, dyes, fragrances, and the like, in solution form from the dispenser in response to a lowering of the height of the body of liquid from a first elevation to a second elevation. More specifically, the present invention relates to a passive dispenser comprising two separate dispensing sections codispensing respective solutions simultaneously, said dispenser having no moving parts.

BACKGROUND OF THE INVENTION

Numerous devices for dispensing a cleaning or disinfectant solution into a toilet tank for flow into the toilet bowl when the tank is flushed are known. These devices can be characterized as active dispensers, wherein valves or other mechanisms are used to initiate flow from the dispenser when the toilet tank is emptied to a given level, or as passive dispensers, wherein no moving parts are employed, the flow of a predetermined amount of solution from the dispenser being actuated solely by a lowering of the height of the water contained in the tank. Exemplary of the former class, i.e., active dispensers, are devices described in U.S. Pat. No. 1,307,535 to Ciancaglini; U.S. Pat. No. 2,692,165 to Sinkwich; U.S. Pat. No. 3,341,074 to Pannutti; U.S. Pat. No. 3,698,021 to Mack, et al; U.S. Pat. No. 3,778,849 to Foley; U.S. Pat. No. 4,036,407 to Slone, and U.S. Pat. No. 4,244,062 to Corsette. A disadvantage of these active-type dispensers is a tendency for the valve or other mechanical actuating means to become clogged, and thus fail in an open or closed position. Passive-type dispensers overcome this particular problem inasmuch as there are no moving parts that can fail to operate in the proper manner.

In one type of such passive dispenser, the dispenser is alternatively flooded when the tank is filled and emptied (at least partially) by siphoning solution therefrom when the tank is flushed. See, for example, U.S. Pat. No. 650,161 to Williams, et al; U.S. Pat. No. 969,729 to Smith; U.S. Pat. No. 1,144,525 to Blake; U.S. Pat. No. 1,175,032 to Williams; U.S. Pat. No. 1,213,978 to Thornton; U.S. Pat. No. 1,987,689 to Lewis, and U.S. Pat. No. 3,339,801 to Hronas. In another type of passive dispenser, the dispensing device is alternately flooded and drained gravitationally, as illustrated in U.S. Pat. No. 991,825 to Bogie; U.S. Pat. No. 3,121,236 to Yadro, et al; U.S. Pat. No. 3,423,182 to Klasky; U.S. Pat. No. 3,504,384 to Radley, et al; U.S. Pat. No. 3,545,014 to Davis; U.S. Pat. No. 3,604,020 to Moisa; U.S. Pat. No. 3,618,143 to Hill, et al; U.S. Pat. No. 3,769,640 to Castronovo; U.S. Pat. No. 3,772,715 to Nigro; U.S. Pat. No. 3,781,926 to Levey; U.S. Pat. No. 3,867,101 to Herring; U.S. Pat. No. 3,943,582 to Daeninckx, et al, and U.S. Pat. No. 3,952,339 to Baur, et al.

U.S. Pat. No. 2,688,754 to Willits, et al; U.S. Pat. No. 3,073,488 to Komter; U.S. Pat. No. 3,784,058 to Buchtel; U.S. Pat. No. 3,864,763 to Spransy; U.S. Pat. No. 3,895,739 to Buchtel, and U.S. Pat. No. 3,965,497 to Corsette and U.K. Patent No. 705,904 disclose toilet chemical dispensers wherein the head of liquid solution within the container forces solution therefrom when the tank water level falls below the spout of the dispenser.

Filling of the tank above the discharge spout prevents solution from leaving the dispenser. In a further type of passive dispenser, the solution to be dispensed is connected to a pressurized water supply such as the trap refill pipe in a toilet tank. See, for example, U.S. Pat. No. 3,407,412 and U.S. Pat. No. 3,444,566 to Spear, wherein the direction of flow alternates in labyrinth passages.

Passive dispensers using air locks, i.e., pockets of air to isolate the solution, particularly a disinfectant solution, from the tank water during quiescent periods in a toilet tank are also known. See, for example, U.S. Pat. Nos. 4,171,546, 4,186,856, and U.S. Pat. No. 4,208,747 to Dirksing and U.S. Pat. No. 4,216,027 to Wages; U.S. Pat. No. 4,251,012 to Owens, et al; U.S. Pat. No. 4,281,421 to Nyquist, et al; U.S. Pat. No. 4,305,162 to Cornelisse, Jr., et al, and U.S. Pat. No. 4,307,474 to Choy.

SUMMARY OF THE INVENTION

It is an object of the present invention to codispense a first solution and a second solution into a body of liquid from a passive dispenser having separate sections for each solution.

It is a further object of the invention to provide a dispenser containing a cleaning solution and a disinfectant solution in substantial isolation one from the other, said solutions being dispensed into a body of liquid in response to a lowering of the level of said body of liquid from a first elevation to a second elevation.

Another object of the present invention is to maintain the in-tank concentrations of the surfactant solute and especially of the disinfectant solute at low-levels during quiescent periods, i.e., between flushes, which concentrations arise in view of diffusion or migration of said solutes from their respective chambers of the dispensing device.

Another object of the invention is to avoid interaction of said first and second solutions prior to the codispensation of same.

A primary object of the invention is to provide a passive dispenser having the above cited objects and advantages suitable for use in a toilet tank.

These and other objects and advantages of the present invention will be more fully understood upon inspection of the drawings and upon reading of the detailed description, a summary of which follows.

The passive dispenser of the present invention comprises two dispensing sections, the first dispensing section comprising a first product chamber for containing, preferably, a cleaning solution comprising surfactant, fragrance and dye, and the second dispensing section comprising second and third product chambers for containing, preferably, a disinfectant solution.

The first product chamber has an inlet/outlet pathway providing fluid communication between said chamber and the body of liquid, said pathway entering the first chamber at a predetermined distance below the top thereof. The pathway configuration is adapted to discharge the volume of solution above the inlet of the pathway to the chamber by siphon flow. The first chamber is further provided with a vertical vent conduit that extends from the top of the chamber, and which provides fluid communication with the atmosphere when the dispenser is in operative position in the body of liquid. Together, the first chamber, the vent conduit, and the inlet/outlet pathway comprise the first dispensing section of the dispenser.

The second dispensing section comprises the second product chamber and the third product chamber, the third chamber being positioned at least partially above the top of the second chamber. Neither the second nor the third product chamber is in direct fluidcommunication with the first chamber. However, conduit is provided to establish fluid communication between the second and the third chambers, said conduit entering the second product chamber proximate the bottom thereof. A refill/discharge pathway provides a path of fluid communication between the second chamber and the body of liquid, and enters the second chamber at the top in such manner as to provide a vertical barrier to flow therefrom. A conduit vents the second chamber as well as the refill/discharge pathway during filling of the dispenser, the conduit extending from the top of the refill/discharge pathway and preferably being directed to the top of the third chamber. The third chamber is vented directly by means of a conduit extending from the top thereof, and which provides fluid communication with the atmosphere when placed operatively into the body of water.

During operation a predetermined volume of solution is dispensed from each section. During quiescent periods, i.e., periods between flushes, each section of the dispenser is designed so that concentrations of surfactant and disinfectant in the body of liquid arising from the migration or diffusion of solute from the product chambers are low.

BRIEF DESCRIPTION OF THE DRAWINGS

FIGS. 2 to 6 are rear views of the present invention operably placed within the body of liquid, backing substrate omitted, and which provide sequential representation of a discharge/refill cycle.

FIG. 7 is a cross-sectional view of the dispenser of FIG. 1 across section 7—7 of FIG. 1.

DETAILED DESCRIPTION OF INVENTION

Figure 1:
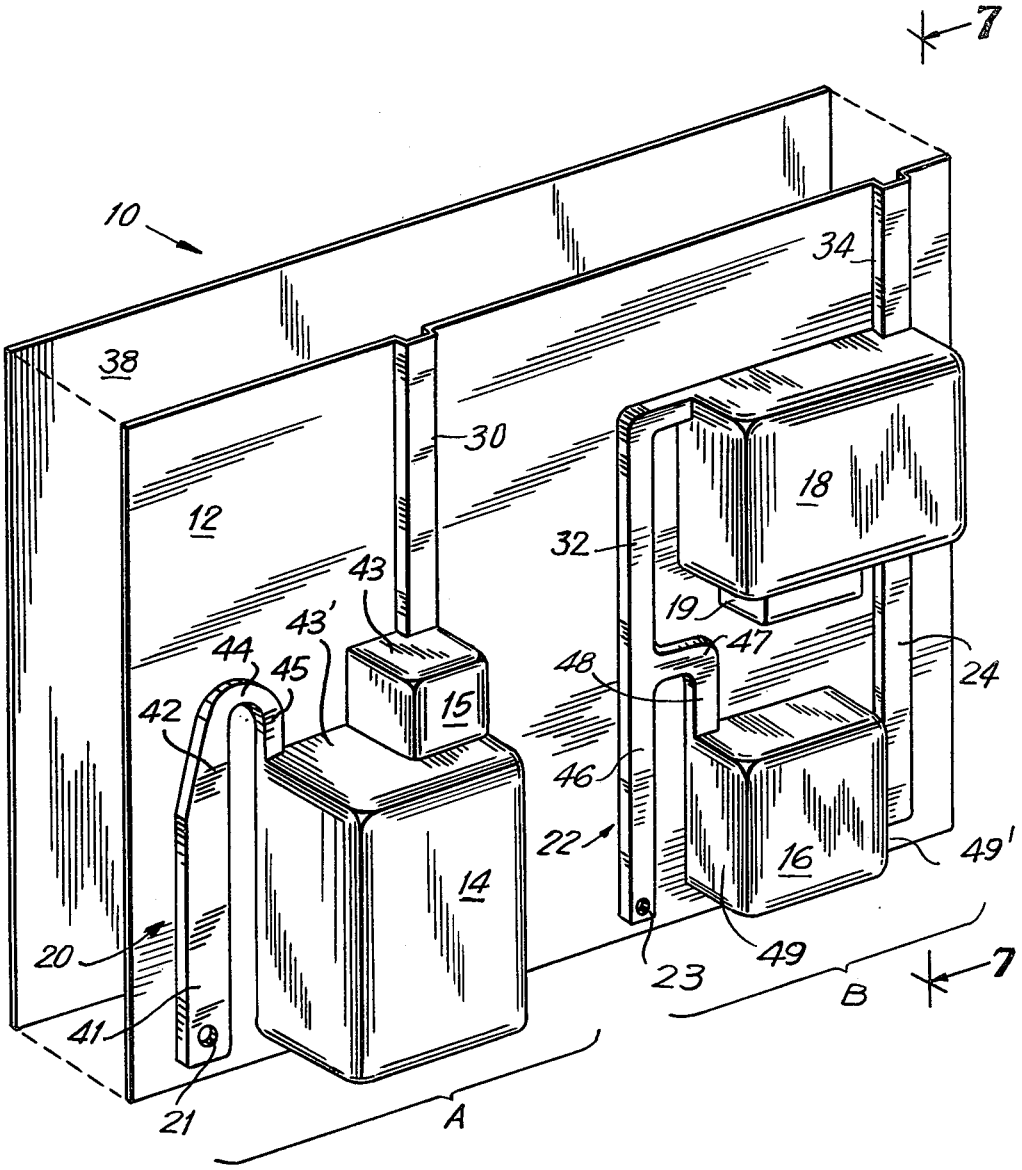
FIG. 1 is an exploded perspective view of the preferred embodiment of the dispenser of the present invention.

According to the present invention, there is provided a dual section passive dispensing device that codispenses a first solution and a second solution simultaneously into a body of liquid, e.g., a toilet tank, upon a lowering of the liquid level from a first elevation to a second elevation, e.g., upon flushing. When used in a toilet tank, the combined solutions then flow into the toilet bowl. The dispensing sections are separate one from the other, both sections being in fluid communication with the tank water, and both sections being designed so that concentrations of the surfactant and disinfectant in the body of liquid arising from the migration or diffusion of respective solutes into the tank water during quiescent periods, i.e., periods between flushes, are low.

The material contained in one dispensing section is a disinfectant that is a halogen-releasing agent of relatively low solubility provided in the form of a water soluble cake, bar, or packet, as hereinafter defined. Disinfectant materials that can be used as the halogen-releasing agent, are, for example, para-toluenesulfondichloramide; halogenated hydantoins, i.e., 1,3-dichloro-5,5-dimethylhydantoin, 1-bromo-3-chloro-5,5-dimethylhydantoin, and 1,3-dibromo-5,5-dimethylhydantoin; and trichloroisocyanuric acid. Solubility of the disinfecting material should be less than 5.0 gms./100 gms. water at 77° F., preferably less than 2.0 gms./100 gms., most preferably less than 1.0 gms./100 gms. The disinfectant cake can also include constituents such as binders to provide strength to the cake, both in the dry state to facilitate handling and in the wet state to prevent disintegration; lubricants, and buffering agents. Dyes are specifically not incorporated in the disinfectant cake in view of chemical interaction with the disinfectant agent, an oxidizing agent.

Preferred disinfectants are N-halogenated hydantoin compounds, especially, 1-bromo-3-chloro-5,5-dimethylhydantoin (BCDMH). N-halogenated compounds disinfectant agents of the type referred to in Paterson, U.S. Pat. No. 3,412,021, which compounds are in agglomerate form and have a solubility in water of from about 0.0001 to about 1% by weight at 20° C., can be used. The Paterson patent is incorporated herein by reference thereto. BCDMH in agglomerated form has a solubility of about 0.15% by weight at 77° F.

The other dispensing section is provided with a cleaning solution comprising one or more surfactants selected from the group consisting of anionic, nonionic, cationic, and amphoteric surfactants, dyes, fragrances, binders, thickeners, fillers, solubility control agents, and buffering agents.

Preferred anionic surfactants include alkali metal alkyl, alkenyl, and alkylaryl sulfate and sulfonate salts of the general formulas $ROSO_3M$ and $RSO_3M$, respectively, wherein R is an alkyl or alkenyl of 8 to 20 carbon atoms or an alkylaryl group, the alkyl portion of which is a straight or branched aliphatic chain of 9 to 15 carbons, the aryl portion of which is a phenyl member, and M is an alkali metal, e.g., sodium, potassium or lithium, or an amine or ammonium. The anionic surfactant may also be an alkali metal salt alkyl phenol ethylene oxide ether sulfate with between 1 to 10 ethylene oxide units per molecule, the alkyl radical containing from 8 to 12 carbon atoms. A preferred anionic surfactant is sodium alpha-olefin sulfonate available as flakes from Lakeway Surfactant Co. under the trademark Siponate 301-10F.

The nonionic surfactant may be an alkylene oxide condensate, an amide or semi-polar agent. The alkylene oxide condensates, include polyethoxylated aliphatic alcohols, the alkyl chain having between 8 to 20 carbon atoms, and the number of ethylene oxide units being between 4 and 12; polyethoxylated alkyl phenols wherein the alkyl group contains between 6 and 12 atoms and the number of ethylene oxide units between 5 to 25; difunctional block polymers of polyoxyalkylene derivatives of propylene glycol, and tetrafunctional polyether block polymers of polyoxyalkylene derivatives of ethylenediamine. Amide-type nonionics are the ammonia and ethanolamides of fatty acids whose acyl portion contains from 8 to 18 carbon atoms while the semi-polar type nonionics are the amine oxides, phosphine oxides and sulfoxides. Preferred nonionics are condensates of ethylene oxide with hydrophobic bases formed by condensing propylene oxide with propylene glycol. Exemplary of this surfactant group are the surfactants sold under the trademark Pluronic by BASF Wyandotte, e.g., Pluronic F-108 and Pluronic F-127. Also preferred are tridecyl- and decyloxypoly(ethyleneoxy) ethanols sold under the trade name Emulphogene by GAF Corporation, eg., Emulphogene TB-970, a tridecyloxypoly(ethyleneoxy) ethanol in flake form.

Cationic surfactants can be incorporated into the surfactant cake. Because cationic surfactants are typically incompatible with anionic surfactants, the use of cationics is generally limited to anionic free cakes, wherein the cationic surfactant is incorporated to provide germicidal activity or to regulate surfactant solution properties. Exemplary of cationic surfactantss suitable herein are alkyl dimethyl benzyl ammonium chlorides, i.e., Ammonyx T and BTC 1326 sold by Onyx Chemical Company; alkyl dimethyl-1-naphthy-methyl ammonium chlorides, i.e., BTC-1100R sold by Onyx Chemical Company, and the Triton RW-Series surfactants, which have the chemical formula $RNH(OCH_2CH_2)_nOH$, wherein n=1 to 15.

Suitable amphoteric surfactants include betaine derivatives, e.g., coco betaines such as Ampho B11-34 sold by Capital City Products, cocoamidopropyl betaine such as Cycloteric BET C-30 sold by Cyclo Chemicals; imidazolines, e.g., lauric-based imidazoline amphoteric, monocarboxylic sold by Quad Chemicals under the trade name Carsonam L; and the diethanolamine and sodium salts of dicarboxylic tall oil and coconut oil derivatives, e.g, Miranol C 2M sold by Miranol Chemical Co. The amphoteric surfactants are preferably used in combination with the anionic surfactants and are incorporated within the cake to regulate foaming and other properties of the surfactant solution.

The dispenser of the present invention contains two disinfectant cakes each containing an amount of disinfectant that in total provides a useful dispenser life of from about two to three weeks to about several months, based on normal use of about 10 to 20 flushes per day. Typically, this criteria suggests disinfectant cakes each of from about 15 to 100 grams, the disinfectant therein being at least 30% by weight. The remainder comprises on a weight basis up to 70% binder, less than 10% of the and buffering agent, and up to about 5.0% lubricant. The wide variation in cake size and disinfectant amount for the typical disinfectant cake exists in view of the different solubilities of the disinfectant agents and in view of the varying bacteriostatic activities thereof.

The surfactant cake incorporated within the dispenser contains an amount of surfactant that provides cleaning over the useful life of the dispenser, as noted above with respect to the disinfectant cake. A typical surfactant cake ranges from about 30 to about 150 grams, the surfactant therein being at least about 30% by weight. Preferably dye and fragrance are incorporated into the surfactant cake, each being present in amounts of between 2 to 15% of the cake by weight. The amount of dye and fragrance incorporated within the cake is, of course, dependent upon the efficacy of the agent selected, and should be sufficient to provide activity for the useful life of the dispenser. A particularly preferred dye is FD&C Blue No. 1, C.I. No. 42,090. Preferably, the surfactant cake is a combination of several surfactants, thereby regulating the dissolution characteristics of the cake as well as the physical properties of the surfactant solution. A preferred surfactant cake comprises on a weight basis between about 15 to 50% Pluronic nonionic surfactant, between about 10 to 40% Emulphogene nonionic surfactant, about 10 to 40% alpha-olefin sulfonate anionic surfactant, between about 5 to 12% dye, and from about 5 to 12% fragrance.

A portion of the surfactant cake is dissolved by water entering the surfactant dispensing section upon refilling of the tank following the lowering of the liquid level to the second elevation. In solution the surfactant material tends to form a concentration gradient that increases towards the bottom of the chamber. Furthermore, the viscosity and surface tension of the concentrated surfactant solution within the chamber are such that the downward settling of the surfactant material is favored rather than upward diffusion. Hence, by providing a vertical barrier over which the solution flows upon discharge, as is hereinafter described, coupled with the properties of the dissolved surfactant material, the rate and amount of migration of surfactant material to the tank is kept well within tolerable levels. Viscosity of the concentrated surfactant solution, which varies over the life of the product, is typically from about 50 to about 1,200 cp. at 25° C., preferably from about 100 to about 800 cp., and surface tension is typically from about 30 to about 50 dynes/cm. at 25° C., proximate the bottom of the chamber.

Referring to FIG. 1, an exploded perspective view of the preferred embodiment of the dispenser 10 of the present invention, the dispenser 10 comprises a first plastic substrate 12 and a second plastic substrate 38, the first substrate being molded as to provide in unitary fashion two dispensing sections A and B, the two substrates being sealed together after the surfactant and disinfectant materials have been incorporated therein.

Section A of the dispenser 10 comprises a first product chamber 14, an inlet/outlet pathway 20, and a vent conduit 30, said vent conduit 30 extending upwardly from the top 43 of chamber 14. Section B of the dispenser 10 comprises a second product chamber 16 and a third product chamber 18, said chamber 18 being at least partially above the chamber 16, conduit means 24 connecting said second and third chambers, a vent conduit 34 extending from the top of the third chamber 18, a refill/discharge pathway 22, and means to vent both the chamber 16 and the pathway 22. In FIG. 1, a vent conduit 32 connecting the top of the refill/discharge pathway 22 to the third chamber 18, vents the pathway 22 and the chamber 16. Product chamber 14 is separate and apart from the product chambers 16, 18, which product chambers operate as a single dispensing chamber as described below in greater detail. When assembled with substrate 12 sealed to substrate 38, the dispenser also comprises the materials to be dispensed from the dispenser, and, optionally, means (not shown) to suspend the dispenser from the tank wall, for example, a toilet tank, whereby the materials within the dispenser are dispensed as solutions in response to a lowering of the body of liquid contained in the tank from a first elevation to a second elevation.

As shown in FIG. 1, the product chamber 14 of section A is provided with a product solution reservoir 15 located in the upper portion of said chamber 14. Vent 30 extends from the top of the reservoir 15 to the top edge of substrate 12, and vents said reservoir (and chamber) to the atmosphere when the dispenser is in operative position in the tank water. Inlet/outlet pathway 20 comprises a vertical section 41 having a divergent top portion 42, said vertical section 41 being connected to the shoulder 43' of the chamber 14 by means of an inverted U conduit 44 having vertical portion 45. Proximate the bottom end of vertical section 41, which is otherwise sealed, is an inlet/outlet orifice 21 through which liquid enters and leaves section A of the dispenser 10.

In dispensing section A of the dispenser 10, the inlet/-outlet pathway 20, in combination with atmospheric vent means 30, provides siphon discharge of the solution contained within chamber 14. Hence, vertical section 41 of pathway 20 extends below the level of the shoulder 43' and U conduit 44 enters the product chamber 14 at a predetermined distance below the top of the chamber 14, designated by numeral 43. The volume of solution dispensed is equal to or essentially equal to the volume of reservoir 15 that lies above shoulder 43'. As illustrated in FIG. 1, the entire volume of reservoir 15 lies above the entrance of U conduit 44, the vertical portion 45 retarding migration or diffusion of solute from chamber 14 during quiescent periods.

In dispensing section B, chamber 16, located at least partially below chamber 18, is provided with refill/discharge pathway 22 comprising a vertical section 46 and an L-shaped conduit, 47 connecting the vertical section 46 to the top of the chamber 16. The vertical portion 48 of the conduit 47 is also capable of retarding migration or diffusion of solute from the chamber 16 and 18 during quiescent periods. Vertical section 46 is provided proximate to its bottom end, which end is otherwise sealed, with an inlet/outlet orifice 23. The chamber 16 and pathway 22 is vented through vent 32, which extends from the top of vertical section 46 of pathway 22, and which is routed in FIG. 1 through the upper chamber 18. However, vent 32 could extend to the perimeter of substrate 12, and not be in fluid connection with chamber 18.

Chamber 18 is connected to chamber 16 by means of conduit 24, which enters the chamber 16 proximate to the bottom of said chamber and on the wall 49, which wall is directly opposite wall 48. The conduit 24 preferably enters the chamber 18 along its bottom wall, preferably proximate to a side wall thereof. Vent 34 proceeds from the top of the chamber 18 to the perimeter of substrate 12. Chamber 16 and pathway 22 is vented by means of vents 32 and 34 in the embodiment shown.

The substrates 12, 38 are fabricated preferably from a thermoplastic material, for example, polyvinyl chloride, polyethylene, polystyrene, cellulosic resin, acrylic resin, by thermoforming processes well known in the art. Without the backing substrate 38, the aforesaid product chambers, vents, etc., are accessible from the rear of the substrate 12, said substrate 12 being analagous in construction to a "blister pak" package. After filling the product chambers with the material to be dispensed (in solid form as hereinafter described), the two substrates are most easily joined by heat sealing or radio frequency sealing, although other appropriate bonding methods, for example, a suitable adhesive, may be used.

Figure 2:
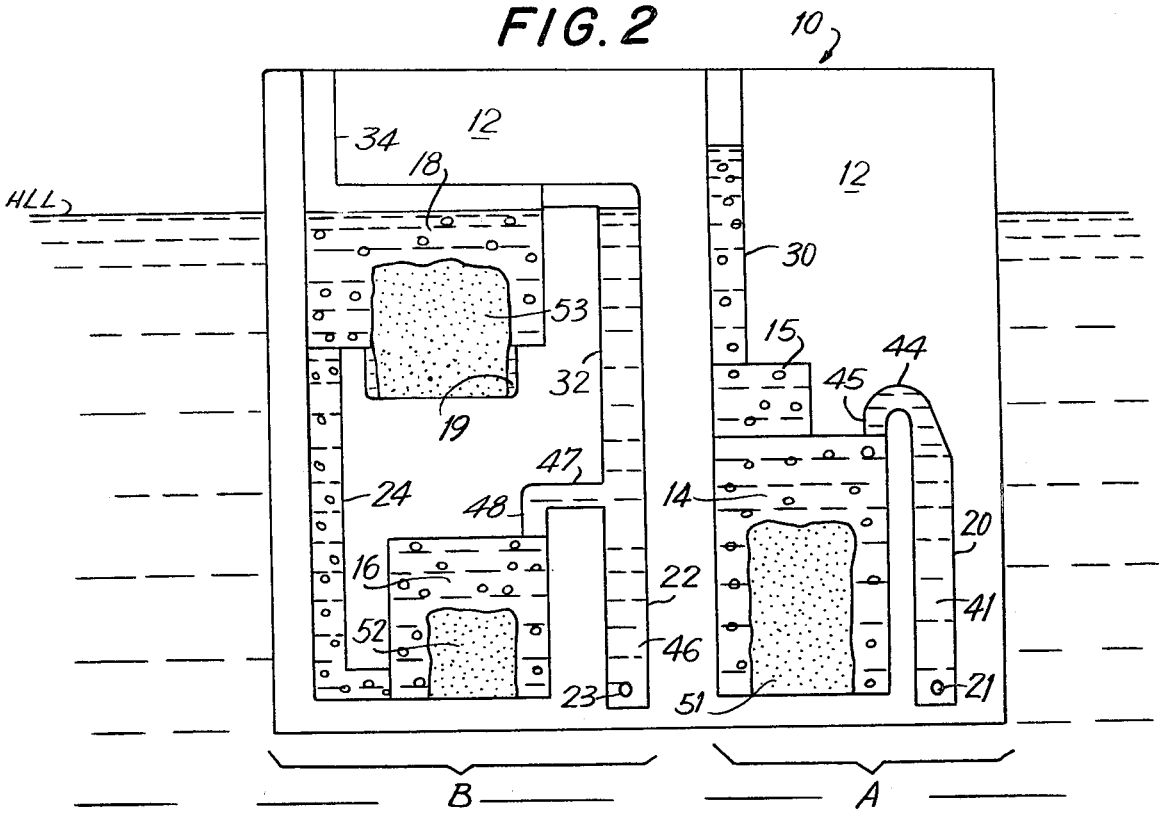

FIGS. 2 to 6 show the dispenser 10 from the rear within the body of liquid, the backing substrate 38 removed. In so doing the interior of the dispenser may be viewed as in cross section, the FIGS. 2 to 6 illustrating sequentially a discharge and refill cycle. The tank into which dispensing occurs is not shown, only the water in the tank being illustrated. The dispenser 10 is in operative position when the HLL is below the top of substrate 12, but above about the midpoint of chamber 18. Preferably, as shown in FIG. 2, the HLL is aligned with the lower edge of the horizontal portion of vent conduit 32, thereby preventing diffusion of solution in chamber 18 into said conduit. Indicia can be provided on the substrate 12 to designate the positioning of the dispenser in the tank.

Material to be dispensed, represented by solid bars or cakes 51, 52, 53, are disposed in product chambers 14, 16 and 18, respectively, the cake 51 containing as an active constituent at least one compound selected from the group consisting of dyes, surfactants, fragrances, and mixtures thereof, while the cakes 52, 53 contain as an active constituent a disinfectant halogen-releasing agent of low solubility. The materials to be dispensed may also exist in forms other than a bar or cake, for example, as a tablet, as a gel or semisolid, as a coating or impregnate with a suitable carrier, or as a pulverulent material within a water-permeable membrane.

Referring to FIG. 2, the dispenser 10 is within the body of water (i.e, a filled toilet tank, not shown), the water being quiescent within the tank at the high liquid level, HLL (i.e., between flushes). Product chambers 14 and 18 are vented to the atmosphere through respective vents 30 and 34. The materials to be dispensed comprising or contained in the bars 51, 52 and 53 go into solution, which solutions achieve equilibrium concentration over time. The chambers 14, 16, 18 are in fluid communication with the tank water. Hence, migration of solute from chambers 14 and 16 (and from 18 through 16) may occur by diffusion. While high rates of migration would result in reduction of dispenser life, the rate of diffusion of solute from each section of the dispenser is quite low. As shown with respect to chamber 14, the U conduit 44 enters the shoulder 43' of the chamber 14 vertically thereby establishing a gravimetric barrier to diffusion. Similarly, with respect to chamber 16, the L conduit 47 enters the top of the chamber 16 vertically also establishing thereby a gravimetric barrier to diffusion. In the case of the detergent and/or dye constituents, preferably comprising cake 51, in view of the moderate solubility and high viscosity thereof, the vertical barrier 45 provided by the U conduit 44 is sufficient to substantially reduce the rate of diffusion from the chamber 14 to the tank water during quiescent periods. In the case of the disinfectant comprising cakes 52 and 53 of the low solubility disinfectant material such as BCDMH, the vertical barrier 48 provided by the L conduit 47 is sufficient to substantially reduce the rate of diffusion from the chamber 16 to the tank water during quiescent periods. Hence, the dispenser 10 can be said to substantially isolate the materials therein from the tank water in view of the construction of the dispenser and the properties of the materials provided in cake form in cakes 51, 52 and 53. In the case of BCDMH, the preferred disinfectant, the solution develops a density gradient within the chamber 16, which gradient provides an inherent deterrent against diffusion. Finally, solute which migrates from the dispenser is substantially diluted by the large volume of water residing in the tank.

Figure 3:
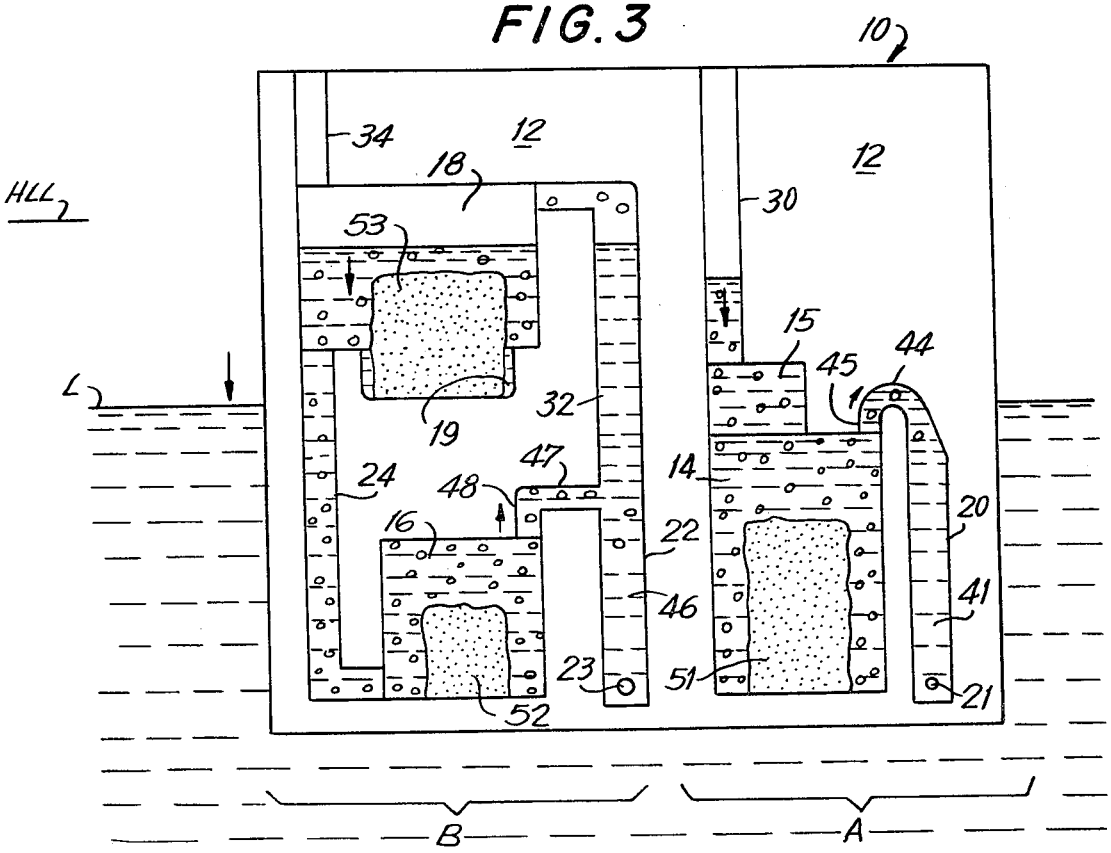

Referring to FIG. 3, upon a flush, the water level L in the tank drops rapidly, more rapidly than the decrease in solution 54 and 55 level in the respective product chambers and accompanying vents. The low flow rate from the dispenser 10 is occasioned by the provision of orifices 21 and 23, which require a moderate head pressure to accelerate flow from the dispenser. Thus, the major portion of solution ultimately dispensed from the dispenser 10 is postponed until the tank water level L drops substantially to near the tank low liquid level LLL as illustrated in FIG. 4.

Figure 4:
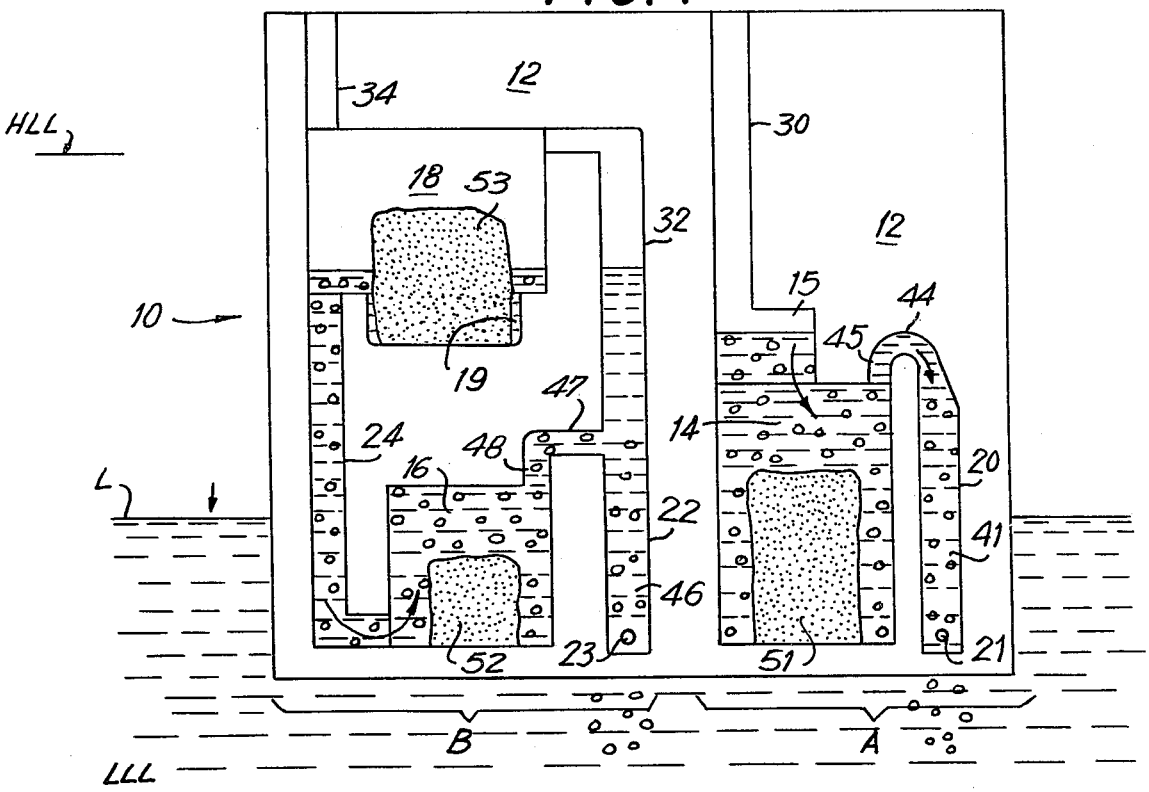
Figure 5:
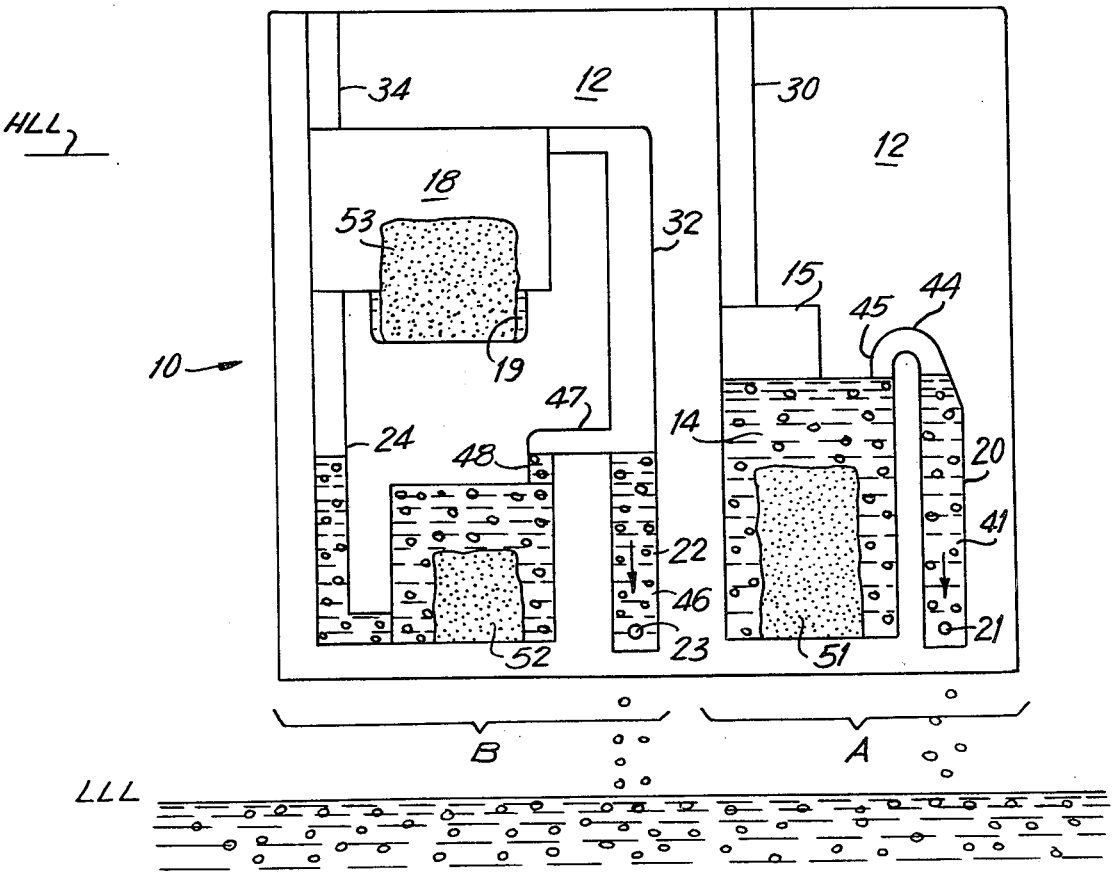

As observed by viewing FIGS. 4 and 5, during the time interval commencing when the tank level L is proximate to the low liquid level LLL (FIG. 4) and ending upon closing of the tank water outlet valve (FIG. 5) (which closing occurs a short time, about several seconds, after the low liquid level is reached), essentially all remaining solution to be dispensed from the product chambers is released, thereby concentrating the cleaning and disinfecting action of the actives at the end of the flush.

As shown in FIG. 5, the amount of solution dispensed into the tank water from chamber 14 is equal to the volume of the product solution reservoir 15, which solution drains through the inlet/outlet pathway 20 by means of the siphon effect created through U conduit 44 and between the reservoir 15 and the tank. In section B, however, discharge of disinfecting solution is by gravity flow. Disinfecting solution from chamber 18 flows by gravity to chamber 16 through conduit 24 and then to the tank through refill/discharge conduit 22. By such construction, solution from chamber 18 is caused to flow past the bar 52 which has been found to increase dissolution of the bar 52, thereby effectively concentrating the disinfectant effluent solution actually dispensed into the toilet bowl, notwithstanding the inherently low solubility of the disinfectant cake material. In both sections A and B a quantity of solution remains behind at the end of the dispensing cycle, which residual solution forms somewhat diluted solution that can be dispensed immediately upon refilling of the chamber.

In FIG. 6, tank water level L has risen as shown. Water has entered chamber 14 through pathway 20, air leaving the chamber 14 through vent 30. Water has also entered chamber 16 through pathway 22. Air contained within the L conduit 47 is vented through vent 32. Inasmuch as chamber 16 remains full, no air needs to be vented therefrom, except upon initial use of the dispenser. Several refill/discharge cycles are sufficient to purge air from the chamber 16 at the start of use, the air being vented through L conduit 47 and vent 32. After refilling, the dispenser 10 is as shown in FIG. 2.

FIG. 7 illustrates a cross-sectional view of the dispenser showing the disposition of both substrates 12 and 38. Referring back to FIG. 1, well 19 is optionally provided to entrap particles of disinfectant material that may break off and perhaps clog conduit 24. Alternatively, the inlet of conduit 24 into chamber 18 could be raised, which would likewise prevent clogging. The dispenser may be suspended by conventional means, for example, a hanger engaging the rim of the tank, or may dwell at the bottom of the tank.

What is claimed is:

1. A passive dispenser for containing a quantity of a first solution and a second solution and for codispensing a predetermined volume of said first solution and said second solution into a body of liquid in which said passive dispenser is placed in response to the level of said body of liquid being lowered from a first elevation to a second elevation, the passive dispenser comprising:

a first dispensing section comprising:

a first product chamber, said chamber containing a water-soluble cake forming, upon dissolution, the first solution;

a vent conduit extending upwardly from the top of the first chamber, and an inlet/outlet pathway providing fluid communication between said chamber and the body of liquid, said pathway entering the chamber at a predetermined distance below the top thereof and adapted to discharge the volume of solution thereabove by siphon flow, and a second dispensing section in separate relationship from the first, said second dispensing section comprising:

a second product chamber containing a water-soluble cake forming, upon dissolution, the second solution;

a third product chamber, said third chamber being disposed at least partially above said second chamber, and containing a water-soluble cake also forming, upon dissolution, the second solution;

a vent conduit extending upwardly from the top of the third chamber;

a conduit establishing fluid communication between the second product chamber and the third product chamber, said conduit entering the second product chamber proximate the bottom thereof;

a refill/discharge pathway providing fluid communication between the second chamber and the body of liquid, said pathway entering said second chamber as to provide a vertical barrier to flow therefrom, and conduit means to vent said second chamber and said refill/discharge pathway, said conduit means extending upwardly from the top of the refill/discharge pathway, whereby, when the body of liquid is lowered from the first elevation to the second elevation, a predetermined volume of solution in the first chamber is dispensed from the first dispensing section by siphon flow and a predetermined volume of solution in the second and third chambers is dispensed from the second dispensing section by gravity flow.

2. A passive dispenser for containing a quantity of a first solution and a second solution and for codispensing a predetermined volume of said first and said second solutions into a body of liquid in which said passive dispenser is placed in response to the level of said body of liquid in which said passive dispenser is placed in response to the level of said body of liquid being lowered from a first elevation to a second elevation, the passive dispenser comprising:

a first substrate and a second substrate sealably joined to the back of the first substrate, said first substrate being molded as to provide two dispensing sections for parallel operation, the first dispensing section comprising:

a first product chamber containing a water-soluble surfactant cake forming upon dissolution a surfactant solution;

a vent conduit extending upwardly from the top of said chamber to the perimeter of the sealed substrates, and an inlet/outlet pathway providing fluid communication between said chamber and the body of liquid, said pathway entering the chamber at a predetermined distance below the top thereof and adapted to discharge the volume of surfactant solution thereabove by siphon flow, and a second dispensing section comprising:

a second and a third product chamber, the third product chamber being disposed at least partially above the second chamber, said chambers each containing a disinfectant cake forming, upon dissolution, a disinfectant solution;

a conduit between said second and third product chambers, said conduit entering the second product chamber proximate the bottom thereof;

a refill/discharge pathway providing fluid communication between the second chamber and the body of liquid, said pathway entering the second chamber as to provide a vertical barrier to flow therefrom;

conduit means to vent said second chamber and said refill/ discharge pathway, said conduit means extending upwardly from the top of the refill/discharge pathway, and a vent conduit extending upwardly from the top of the third chamber to the perimeter of the sealed substrates, whereby, when the body of liquid is lowered from the first elevation to the second elevation, predetermined volumes of surfactant and disinfectant solutions are codispensed, the surfactant solution being dispensed from the first dispensing section by siphon flow and the disinfectant solution being dispensed from the second dispensing section by gravity flow, said disinfectant solution flowing from the third chamber to the second chamber through the conduit therebetween, and then from the second chamber to the body of liquid through the refill/discharge pathway.

3. The dispenser of claim 1 or 2 wherein the inlet/outlet pathway comprises a vertical conduit portion and an inverted U conduit portion, a leg of the U conduit entering the first chamber at said predetermined distance below the top thereof and providing a vertical barrier to flow from the first chamber, the portion of the first chamber above the inlet of said leg into the chamber being a product reservoir, and wherein the refill/discharge pathway comprises a vertical conduit portion and an L-shaped conduit portion, a leg of said L-shaped conduit portion entering said second conduit at the top thereof and providing said vertical barrier to flow therefrom.

4. The dispenser of claim 3 wherein said conduit between the second and third product chambers enters the third product chamber proximate the bottom thereof.

5. The dispenser of claim 3 wherein said conduit between the second and third product chambers enters the third product chamber at a predetermined distance above the bottom thereof.

6. The dispenser of claim 3 wherein the conduit means to vent said second chamber and said refill/discharge pathway extends upwardly and is in fluid communication with the atmosphere.

7. The dispenser of claim 3 wherein the conduit means to vent said second chamber and said refill/discharge pathway extends upwardly and is in fluid communication with the third product chamber proximate the top thereof.

8. The dispenser of claim 3 wherein the product reservoir forms a shoulder with the lower portion of the second chamber, the leg of the U conduit portion entering said shoulder.

9. The dispenser of claim 3 wherein the vertical conduit portions of the inlet/outlet pathway and the refill-/discharge pathway each has an inlet/outlet orifice proximate the bottom of said vertical sections, said pathways otherwise being sealed off from the body of liquid.

10. The dispenser of claim 3 wherein said cake contained in the first product chamber is a surfactant cake comprising a surfactant selected from the group of anionic, nonionic, cationic, and amphoteric surface active agents, and compatible combinations of same, and optional adjuvants selected from the group consisting of dyes, fragrances, thickeners, fillers, solubility control agents, and buffering agents, and wherein said cakes in the second and third product chambers are disinfectant cakes containing a halogen-releasing agent having a solubility of less than about 5.0 gms./100 gms. of water at 77° F.

11. The dispenser of claim 10 wherein the halogen-releasing agent is selected from the group consisting of N-halogenated hydantoins, chloramine derivatives and isocyanurates having a solubility of less than about 2.0 gms./100 gms. of water at 77° F.

12. The dispenser of claim 10 wherein the halogen-releasing agent is selected from the group consisting of 1,3-dichloro-5,5-dimethylhydantoin, 1-bromo-3-chloro-5,5-dimethylhydantoin, 1,3-dibromo-5,5-dimethylhydantoin, and mixtures of same, said agents having a solubility of less than 2.0 gms./100 gms. of water at 77° F.

13. The dispenser of claim 12 wherein the disinfectant cakes comprises at least 30% disinfectant by weight and less than 70% binder therefor.

14. The dispenser of claim 12 wherein the halogen-releasing agent is in agglomerated form.

15. The dispenser of claim 13 wherein the surfactant cake contains a mixed surfactant composition consisting essentially of 1 to 10 parts alpha-olefin sulfonate, 1 to 10 parts alkyloxypoly (ethyleneoxy) alcohol, and 0.5 to 5 parts polyoxypropylene polyoxyethylene copolymer condensate.

16. The dispenser of claim 1 wherein the third product chamber has a bottom well.

17. The dispenser of claim 1 further comprising hanging means to suspend the dispenser in the body of liquid.

* * * * *